United States Patent [19]

Novotny et al.

[11] 4,136,642

[45] Jan. 30, 1979

[54] METHOD OF AND APPARATUS FOR REGULATING STEAM AND HOT WATER BOILERS EMPLOYING FLUIDIZED FUEL

[75] Inventors: Pavel Novotny; Ludvik Fiala, both of Prague, Czechoslovakia

[73] Assignee: CKD DUKLA, narodni podnik, Prague, Czechoslovakia

[21] Appl. No.: 841,602

[22] Filed: Oct. 12, 1977

[30] Foreign Application Priority Data

Oct. 13, 1976 [CS] Czechoslovakia ..... 6605/76

[51] Int. Cl.[2] ..... F22B 1/02; F23D 19/02

[52] U.S. Cl. ..... 122/4 D; 110/347; 110/263

[58] Field of Search ..... 122/4 D; 110/263, 264, 110/265, 261, 244, 347

[56] References Cited

U.S. PATENT DOCUMENTS

| | | | |
|---|---|---|---|
| 3,805,715 | 4/1974 | Keller | 110/244 |
| 3,921,590 | 11/1975 | Mitchell et al. | 122/4 D |
| 3,924,402 | 12/1975 | Harboe | 122/4 D |
| 4,072,130 | 2/1978 | Zenz | 122/4 D |

*Primary Examiner*—Kenneth W. Sprague

[57] ABSTRACT

The heating power of the fire box of a boiler burning powdered fuel maintained in suspension by fluidizing air is regulated in dependence on the temperature of the burning fluidized fuel layer by means of a heat transmitting system filled with a liquid medium, a first part of the heat transmitting system being embedded in the burning fluidized fuel layer, a second part of such system being disposed in the boiler drum, and a third part of the system being disposed within the fluidizing air supply. The heat transmitting liquid which is heated by its flow through the first part of the heat transmitting system selectively transmits heat to either the second or the third part of the system whereby to regulate the heat output of the boiler.

5 Claims, 1 Drawing Figure

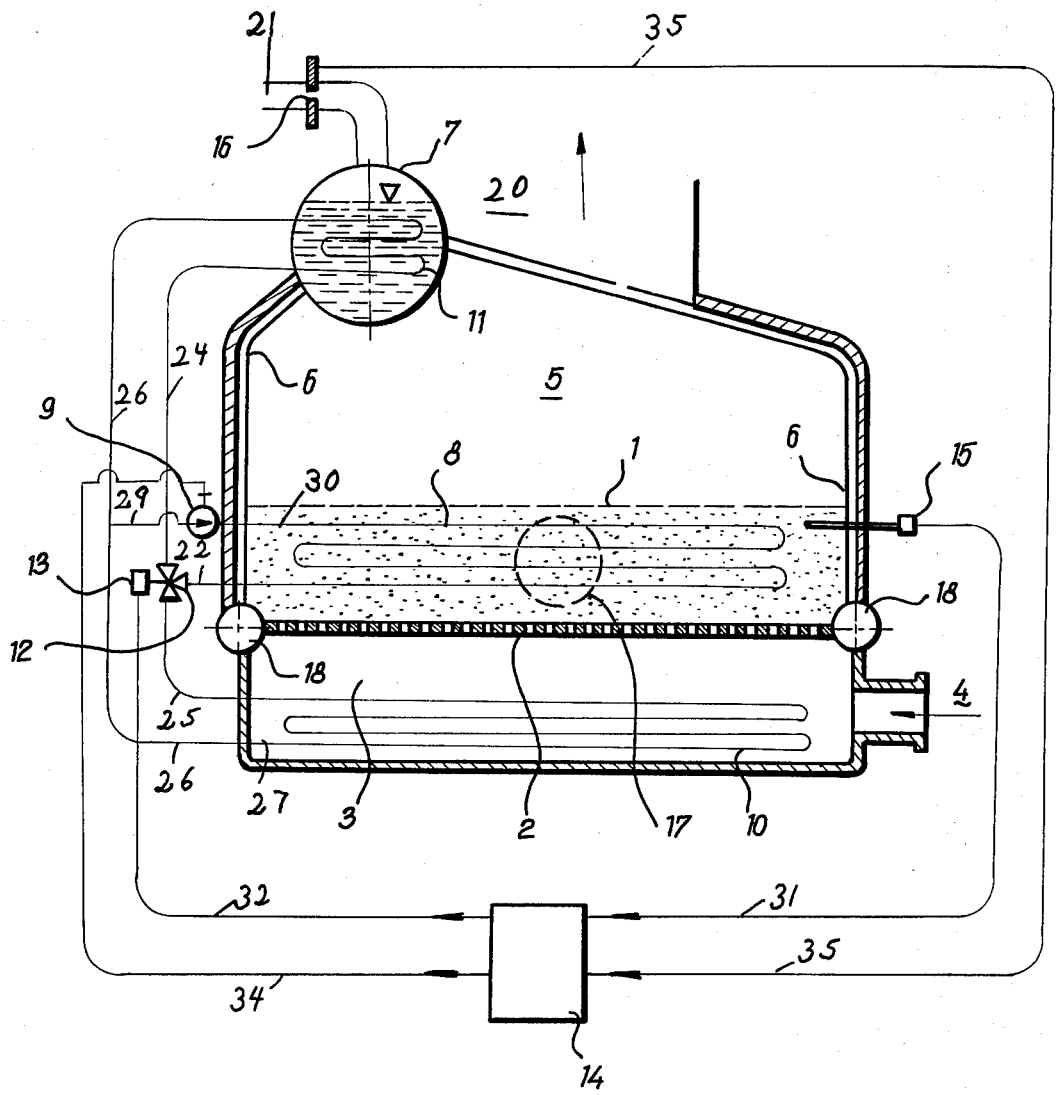
2
35
16
7
20
11
24
6
5
26
9
6
15
8
1
30
29
22
13
18
12
18
4
25
26
27
3
2
17
10
32
31
35
34
14

METHOD OF AND APPARATUS FOR REGULATING STEAM AND HOT WATER BOILERS EMPLOYING FLUIDIZED FUEL

BACKGROUND OF THE INVENTION

The invention relates to a method for regulating the output of a steam or hot water boiler burning powdered fuel maintained in suspension, and to an apparatus for carrying out such method.

The regulation of the output of combustion chambers or fire boxes of steam and hot water boilers burning a fluidized powdered fuel, such boilers being provided with a heat transmitting surface in the fuel layer, is a rather complicated problem. These fire boxes cannot at present be adjusted to conditions of operation in case of a change of the quality of the fuel, such as its caloric value, ash content and particle size. Under certain conditions these fire boxes become either overcooled or insufficiently cooled, conditions which usually are the immediate causes of failures of operation of the boiler.

The overall amount of heat transmitted from the fluid layer to the heat transmitting surface located in the fluid layer is determined by the fundamental functional relation $Q \times k \cdot F \cdot \Delta t$, where Q is the amount of heat transmitted within a time unit in W, k is the heat transmission coefficient $W/m^2\,°C$, F is the size of the surface of heat transmitting surfaces in $m^2$, and $\Delta t$ is the heat drop between the temperature of the fluid layer and the temperature of the medium passing through the heat transmitting system.

There are, for instance, known systems for regulating the output by eliminating a part of the heat transmitting system by screening a part of the grate surface in that this system is embedded in a stable layer instead of in the fluid layer, that is, the value of F of the fundamental relation is regulated.

Another method is also known, wherein the dependence of the variation of the magnitude of the coefficient k on the speed of fluidization is utilized. The fluid mass being burned is composed of two layers capable of being independently fluidized, only the lower layer being cooled.

Neither of these methods is suitable for fire boxes of large dimensions, and in addition they do not respond quickly enough to variations in the coefficient k due to variations of the amount of ash in the powdered fuel and to variations of its particle size.

SUMMARY OF THE INVENTION

It is an object of this invention to provide a method of regulation of fire boxes burning fluidized powdered fuel, which eliminates to a high degree these drawbacks and which is also suitable for larger installations. According to the present invention, a heat transmitting liquid flows forcibly through a first heat transmitting device embedded in the burning fluidized fuel layer, such transmitting heat from the burning fuel layer either to the contents of the boiler by way of a second heat transmitting device in heat transmitting contact with the contents of the boiler, or to the fluidizing air supply, in dependence upon the temperature of the burning fluidized fuel layer. The heat transmitting medium is caused to flow forcibly in either of such two paths. In the case of a reduction in the temperature of the burning fluidized fuel layer the heat transmitted therefrom to the fluidizing air supply increases, and in case of an increase of the temperature of the burning fluidized fuel layer the heat transmitted to the fluidizing air supply decreases.

The main advantage of the invention is the possibility it provides of recirculating heat back into the burning process, and for such recirculation to be performed within a wide range of regulation of the output from zero to one hundred percent, a regulation which it is not possible to achieve with systems using a variation of the size of the surface embedded in the burning fluidized fuel layer for regulation. It is therefore possible to increase gradually and on a long term basis the thermal output of a furnace; the method and apparatus of the invention are particularly advantageous for employment in large heating units.

The heat transmitting liquid is preferably a liquid with a higher boiling point than water, which does not stress the heat transmitting system and the respective fittings by undue pressure, as does water, and which allows even higher levels of the temperature of the heat transmitting medium to be employed.

The method according to the present invention can also be carried out so that the forced passage of the heat transmitting liquid through the part of the heat transmitting system which is embedded in the burning fluidized fuel layer can be simultaneously adjusted in dependence on the temperature of the fluidized fuel layer, so that in case of a reduction of temperature of the fluidized fuel layer the rate of passage of the heat transmitting liquid through the system is reduced, and in the case of an increase in the temperature of the burning fluidized fuel layer the rate of passage of the heat transmitting liquid in the heat transmitting system is increased. This modification of the method in accordance with the invention makes the regulation of the heat output of the boiler still more accurate, as it changes to a limited extent the flow of heat from the fluidized fuel layer to the part of the heat transmitting system embedded in the fluidized fuel layer by a change of the temperature drop $\Delta t$.

In an apparatus for the carrying out of the method of the invention a part of the heat transmitting surface embedded in the fluidized fuel layer is separated and connected by its heat transmitting circuit or system to a heat exchanger in the fluidizing air chamber and to a heat exchanger in the boiler drum by way of a three-way valve controlled by a servo drive, and also connected to an element for evaluating readings supplied by a feeler of the heat of the fluidized fuel layer and by a device which measures the heat output of the boiler.

An apparatus for carrying out the method according to the invention with a finer degree of regulation also has a circulating pump connected to the element which evaluates the readings supplied by the heat feeler.

DESCRIPTION OF THE DRAWING

The single FIGURE of the drawing shows a layout of an apparatus according to the invention.

DESCRIPTION OF PREFERRED EMBODIMENT

The apparatus shown in the drawing is a steam boiler having a combustion chamber or fire box 5 provided with a heat transmitting means composed of two parts. The first part thereof includes tubular elements 18 on both sides of the combustion chamber 5 and tubes 6 close to the side walls of the combustion chamber, tube 6 being connected to a boiler drum 7 which is disposed at the top of the combustion chamber 5 alongside the upper opening or stack 20 of the boiler. The boiler has a horizontal grate 2 spaced from the bottom thereof, there being a fluidizing air chamber 3 beneath the grate, space 3 being fed with fluidizing air through an opening 4 connected to a supply of fluidizing air (not shown). Powdered fuel is supplied to the combustion chamber 5 through a port 17 located above the grate 2, the fluidizing air passing upwardly through the grate 2 forming the thus fed coated fuel into a burning fluidized layer 1. The parts of the boiler thus far described are conventional.

In accordance with the invention there is provided a heat transmitting system having a first part or heat transmitter 8 in the form of a coil of tubing disposed in the fluidized fuel layer 1 in the combustion chamber 5 of the boiler. A second part 11 of the heat transmitting system is in the form of a loop of tubing disposed within the boiler drum 7 of the boiler, which in this instance is a steam boiler. A third part 10 of the heat transmitting system, which is in the form of a coil of tubing, is disposed in the fluidizing air supply chamber 3 of the boiler. Parts 8, 11 and 10 of the heat transmitting system are connected and interact with each other in the manner now to be described.

One end 22 of the loop 8 is connected to a three-way valve 12 which is under the control of a servo driving motor 13, as shown in the drawing. One branch of the valve 12 is connected by a conduit 24 to one end of the loop 11 in the boiler drum 7. The other end of the loop 11 is connected by a conduit 26 to a first end 27 of the loop 10, the other end of loop 10 being connected by a conduit 25 to the second branch of the three-way valve 12. A pipe 29, branching from conduit 26, leads to a circulating pump 9 the output of which is connected to the second end 30 of the loop 8. In one position of the valve 12 it connects the pipes 22 and 24 so that heated liquid travels from the loop 8 to the loop 11, and in the other position of the valve 12 it connects the pipes 22 and 25, so that heated liquid travels from the loop 8 to the loop 10. The circulating pump 9 is driven at variable speeds, as will appear hereinafter, so that the rate of flow of heat transmitting liquid in the heat transmitting system may be varied.

A heat feeler, such as a thermocouple 15, is disposed in the fluidized fuel layer 1 of the boiler. A steam screen 16 disposed in the steam output pipe 21 of the boiler, measures the overall steam output of the boiler. The feeler 15 is connected by wires 31 to an evaluation element 14; the steam screen 16 is also connected to the element 14, in this case by wires 35. A first output circuit 32 from evaluation element 14 is connected to the servo drive 13 for the valve 12 to direct the servo motor 13 to shift the valve 12 into one of its two positions, in the first position the valve connecting loop 8 and 11, in the second position the valve connecting loops 8 and 10.

The heat output of the boiler is regulated by the heat transmitting system 8, 10, 11 so that in case of an increase in the temperature of the fluidized fuel layer 1 the three-way valve 12 controlled by the servo drive 13 which is governed by signals from the evaluation element 14, so as to shut off the passage of the heat transmitting liquid from the loop 8 to the loop 10 in the air chamber 3 and to permit passage of the heat transmitting liquid only to the heat exchanger 11 in the boiler drum 7 thereby to transmit heat to the water of the boiler. At the same time the speed of driving of the circulating pump 9 is increased, thereby to increase the rate of output of the heat transmitting liquid by the pump, whereby the temperature of such liquid is reduced and the temperature drop in it increases together with the amount of heat removed from the fluidized fuel layer 1 by the loop 8.

In the case of a decrease in the temperature of the fluidized fuel layer 1 as determined by the output of the evaluation element 14, the three-way valve 12 is shifted by the servo drive 13 to close off the supply of heat transmitting liquid to the heat exchanger loop 11 in the boiler drum 7, and opens the supply of the heat transmitting liquid to the loop 10 in the fluidizing air chamber 3, so as to transmit heat to the fluidizing air. At the same time the rate of liquid output by the circulating pump 9 is reduced in accordance with the readings yielded by the evaluation element 14, thereby increasing the temperature of the heat transmitting liquid and reducing its temperature drop. Thus the amount of heat taken from the fluidized fuel layer 1 is reduced, and a part of the heat is returned to the fluidized fuel layer 1 by the recirculation of heat. It is to be understood that when the boiler in question is a hot water boiler, rather than a steam boiler, the element 16 will measure the heating power of the hot water boiler.

The described conditions should be considered to be limit conditions, the method and apparatus according to the present invention permitting various combinations of conditions within a wide range, for instance, a simultaneous supply of heat-transmitting liquid to both heat exchangers 10 and 11 with differing outputs of the circulation pump 9.

The "steam screen" 16 is an apparatus of common design by means of which pressure differences are determined in front of and behind this apparatus, which differences are picked up by an electric pick-up device and transmitted via wire 35 to the evaluation element 14.

The evaluation element 14 is a common electronic regulator. It receives the signals transmitted via wire 35 from the steam screen 16; on the basis of these signals and on the basis of predetermined relations, element 14 generates signals for the control of the pump 9 and of the servo-drive 13 of the three-way valve 12.

Although the invention is illustrated and described with reference to a plurality of preferred embodiments thereof, it is to be expressly understood that it is in no way limited by the disclosure of such a preferred plurality of embodiments, but is capable of numerous modifications within the scope of the appended claims.

What is claimed is:

1. A method of regulating the heating power of a stream or hot water boiler burning powdered fuel maintained in suspension by fluidizing air introduced into the combustion chamber of the boiler in dependence on the temperature of the burning fluidized fuel layer and on the heat output of the boiler, the boilers being provided with heat-transmitting means adapted for the passage of a heat-transmitting medium, the heat-transmitting medium having a part disposed in the burning fluidized fuel layer, the method comprising: upon a reduction in the temperature of the burning fluidized fuel layer increasing the rate of transmission of heat by the heat-transmitting medium to the fluidizing air, and upon a rise in the temperature of the burning fluidized fuel layer decreasing the rate of transmission of heat by the heat-transmitting medium to the fluidizing air.

2. A method as claimed in claim 1, wherein the heat-transmitting medium is a liquid with a higher boiling point than that of water.

3. A method as claimed in claim 1, wherein he heat-transmitting liquid is forcibly circulated, and the forced circulation of the heat-transmitting medium is simultaneously controlled in dependence of the burning fluidized fuel layer, so that in the case of a reduction of the temperature of the burning fluidized fuel layer in the boiler, the rate of flow of the heat-transmitting medium is reduced, and that in the case of an increase of the temperature of the burning fluidized fuel layer in the boiler the rate of flow of the heat-transmitting medium is increased.

4. Apparatus for regulating the heating power of a steam or hot water boiler having a boiler drum and burning powdered fuel maintained in suspension by fluidizing air introduced into the combustion chamber of the boiler in dependence on the temperature of the burning fluidized fuel layer and on the heat output of the boiler, comprising a boiler drum, a combustion chamber for a fluidized particulate fuel, an air chamber for fluidizing air below the combustion chamber, means for supplying combustion air from said air chamber to the combustion chamber, means for supplying powdered fuel to be maintained in suspension by the combustion air within the combustion chamber, heat-transmitting means for the passage of a heat-transmitting medium for the regulation of the output of heat by the boiler, a heat-transmitting system containing said heat-transmitting medium, the system having a first part disposed within the burning fluidized fuel layer in the combustion layer, a second part disposed in the boiler drum of the boiler, and a third part disposed in the air chamber of the boiler, valve means adapted to control the flow of the heat-transmitting medium between said parts of the heat-transmitting system, a temperature feeler in the burning fluidized fuel layer in the combustion chamber of the boiler, a device for measuring the heat output of the boiler drum, means for evaluating values measured by said temperature feeler and said device for measuring the heat output of the boiler drum, and means controlled by said evaluation means for controlling the valve.

5. Apparatus as claimed in claim 4, comprising a pump for the forced circulating of the heat-transmitting medium in the system, and means controlled by the evaluating means for controlling the circulation pump.

* * * * *